US006173689B1

(12) United States Patent
Tanaka

(10) Patent No.: US 6,173,689 B1
(45) Date of Patent: Jan. 16, 2001

(54) LUBRICATION ARRANGEMENT FOR ENGINE VALVE ACTUATION

(75) Inventor: Hiroshi Tanaka, Iwata (JP)

(73) Assignee: Yamaha Hatsudoki Kabushiki Kaisha, Iwata (JP)

( * ) Notice: Under 35 U.S.C. 154(b), the term of this patent shall be extended for 0 days.

(21) Appl. No.: 09/416,242

(22) Filed: Oct. 12, 1999

(30) Foreign Application Priority Data

Oct. 12, 1998 (JP) ..... 10-289474

(51) Int. Cl.[7] ..... F01M 1/08; F01M 9/10

(52) U.S. Cl. ..... 123/90.34; 123/90.33; 184/6.5; 184/6.9

(58) Field of Search ..... 123/90.33, 90.34, 123/196 R; 184/6.5, 6.9

(56) References Cited

U.S. PATENT DOCUMENTS 3,628,513 * 12/1971 Grosseau ..... 123/90.34
3,958,541 * 5/1976 Lachnit ..... 123/90.34
4,711,203 * 12/1987 Seidl ..... 123/90.34
4,800,850 * 1/1989 Yoshida et al. ..... 123/90.16
4,807,574 * 2/1989 Shibata et al. ..... 123/90.16
4,858,574 * 8/1989 Fukuo ..... 123/90.34
4,881,497 * 11/1989 Matayoshi et al. ..... 123/90.34
5,172,663 * 12/1992 Fujiwara ..... 123/90.34
5,309,878 * 5/1994 Kandler et al. ..... 123/196 M
5,813,376 * 9/1998 Sakaguchi et al. ..... 123/90.16

* cited by examiner

*Primary Examiner*—Weilun Lo
(74) *Attorney, Agent, or Firm*—Knobbe, Martens, Olson & Bear LLP

(57) ABSTRACT

A push rod operated multi-valve V-type engine particularly adapted for use in motorcycles or like vehicles and which engine is air cooled. The engine employs a very simplified construction and overhead valve actuating mechanism utilizing push rods. The push rods are contained within push rod tubes formed at one side of the engine that provide a neat appearance and ease of servicing without adversely affecting the air cooling. A composite cylinder head construction is employed, as well as an improved and simplified lubricating system for the pair of driven camshafts. Furthermore, a decompression system is incorporated in the valve actuating mechanism so as to facilitate starting.

12 Claims, 12 Drawing Sheets

LUBRICATION ARRANGEMENT FOR ENGINE VALVE ACTUATION

BACKGROUND OF THE INVENTION

This invention relates to an internal combustion engine and more particularly to an improved lubricating system for the valve actuating mechanism of such engines.

In four cycle internal combustion engines, the valves are normally operated by means of a cam shaft that rotates about an axis and is driven by the crankshaft at one-half crankshaft speed. The cam shaft has individual lobes that engage some form of follower mechanism for actuating the valves either directly or via an intermediate mechanism such as tappets, push rods and rocker arms. As is well known, the operating load on the valve actuating mechanism is particularly high especially in the area where the cam lobe contacts the valve actuating follower.

It has been the practice, therefore, to provide adequate lubrication in this area by drilling the cam shaft and cross drilling the cam lobe so that lubricant can be delivered to its surface and to the follower which they engage. Although this type of lubrication system is quite advantageous, it has some disadvantages, particularly with some types of applications.

Obviously, when the cam lobe is rotating and the opening is not engaged with the follower, the lubricating opening of the cam lobe is not adjacent the surfaces to be lubricated. Thus substantial oil will flow out of the opening which must be recaptured and recirculated. This also tends to reduce the pressure in the system and thus, higher pressures must be employed in order to compensate for this pressure loss.

In addition, it is not particularly desirable to drill holes for lubricating purposes through a surface of the cam lobe which functions to engage another member. The edges of such holes can cause scuffing action on the engaged follower.

It is, therefore, a principal object of this invention to provide an improved lubricating system for the cam lobe surfaces and engaged follower of the valve actuating mechanism for an engine.

It is a further object of this invention to provide a lubricating system for the cam lobes and follower of an engine wherein the lubricant is directed primarily to the surfaces that require it.

Frequently, the engine employs a plurality of cam shafts and this further aggravates the problem of providing adequate lubricating. That is, if each cam shaft is lubricated in the prior art type as described, then the problems become somewhat compounded and the amount of machining is significantly increased.

It is, therefore, a further object of this invention to provide an improved arrangement for lubricating a pair of cam shafts that are juxtaposed to each other and their associated follower mechanisms.

SUMMARY OF THE INVENTION

This invention is adapted to be embodied in a lubricating system for an engine valve train. The valve train includes a cam shaft having at least one cam lobe thereon and which is journaled for rotation within an engine body. The cam lobe cooperates with a follower mechanism for operating an associated engine valve. A lubricant delivery passage is provided in the engine in spaced relationship to the cam shaft and specifically its cam lobe. This lubricant delivery arrangement has a discharge port which is directed toward the cam lobe so as to spray lubricant on the cam lobe to lubricate it and the follower which it engages.

In accordance with another feature of the invention, the lubricant spray is directed toward the cam lobe in a direction so that the rotation of the cam lobe will deliver the lubricant to the follower.

In accordance with another feature of the invention, there are provided a pair of cam shafts that rotate about parallel axes and a single lubricant delivery arrangement is disposed between the cam shafts and has discharge openings directed toward the respective cam lobes of each cam shaft.

DETAILED DESCRIPTION OF THE PREFERRED EMBODIMENTS OF THE INVENTION

Figure 1:
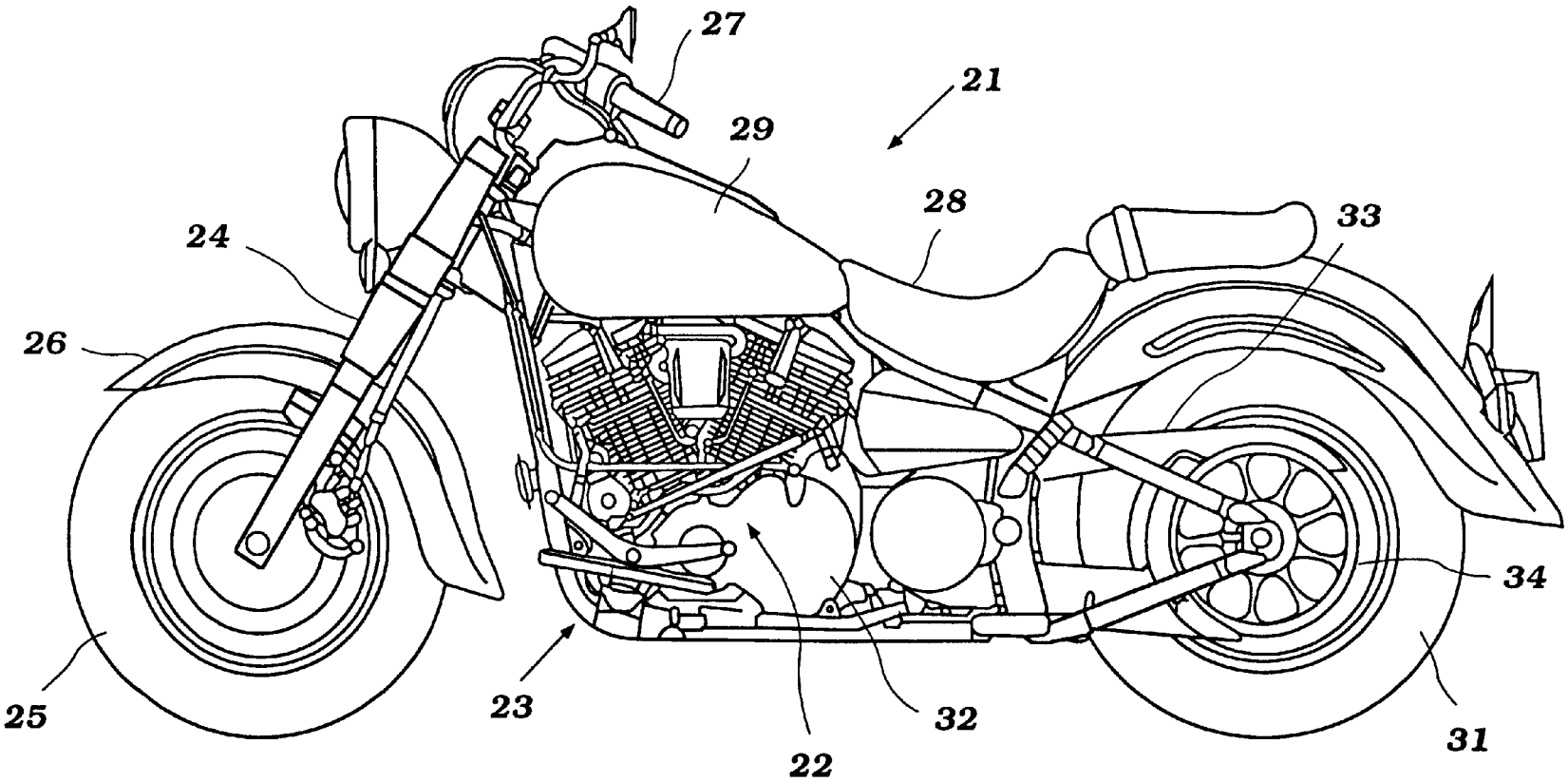
FIG. 1 is a side elevational view of a motorcycle constructed in accordance with an embodiment of the invention.

Referring first primarily to FIG. 1, a motorcycle is illustrated in side elevational view and is identified generally by the reference numeral 21. The motorcycle 21 is powered by an internal combustion engine, indicated generally by the reference numeral 22 and which is constructed in accordance with an embodiment of the invention. The motorcycle 21 is shown as a typical environment in which the invention may be utilized.

For the reasons aforenoted, the invention has particular utility in conjunction with motorcycle applications because the engine 22 is substantially exposed, is air cooled and also must be compact in construction. Although this specific environment is shown as a typical environment with which the invention may be utilized, it will be readily apparent to those skilled in the art how the features of the engine 22 can be utilized with a number of other applications.

The motorcycle 21 is comprised of a frame assembly 23 upon which the engine 22 is suspended in a known manner. This frame assembly 23 dirigibly supports a front fork 24 on which a wheel 25 is rotatably journaled. A fender 26 covers this front wheel 25. The steering of the vehicle is controlled by a handlebar assembly 27 that is fixed to the upper end of the front fork 24 in a manner well known in this art.

A rider's seat 28 is carried by the frame assembly 23 rearwardly of the engine 22 and above it. A fuel tank 29 for the engine is mounted on the frame 23 forwardly of the seat 28.

Finally, a rear wheel 31 is journaled by the frame assembly 23 in a suitable manner and is driven by a transmission contained within a crankcase transmission assembly 32 of the engine 22 through a final drive which may comprise a driving belt covered by a cover 33 for driving a pulley 34 or sprocket fixed for rotation with the rear wheel 31.

The construction of the engine 22 will now be described in more detail referring first primarily to FIGS. 2 and 3. In the illustrated embodiment, the engine 22 is of the V twin type and operates on a four cycle principle. To this end, the engine 22 is comprised of an engine body assembly including a cylinder block portion, indicated generally by the reference numeral 35, which is formed with a pair of angularly related cylinder banks 36 and 37 that are disposed at a V angle to each other. These cylinder banks 36 and 37 are formed by cylinder barrels that are affixed to an upper portion of a crankcase member 38 which with the cylinder banks 36 and 37 completes the cylinder block portion 35.

The crankcase member 38 defines a crankcase portion of the engine body that includes the combined crankcase transmission assembly 32 and rotatably journals a crankshaft 39 in any suitable manner.

Each cylinder bank 36 and 37 is formed with a respective cylinder bore 41 in which a piston 42 reciprocates. The pistons 42 are connected to the upper or small ends of connecting rods 43 in a known manner. The connecting rods 43 are journaled in side-by-side relationship on a throw of the crankshaft 39 as best seen in FIG. 3.

Figure 12:
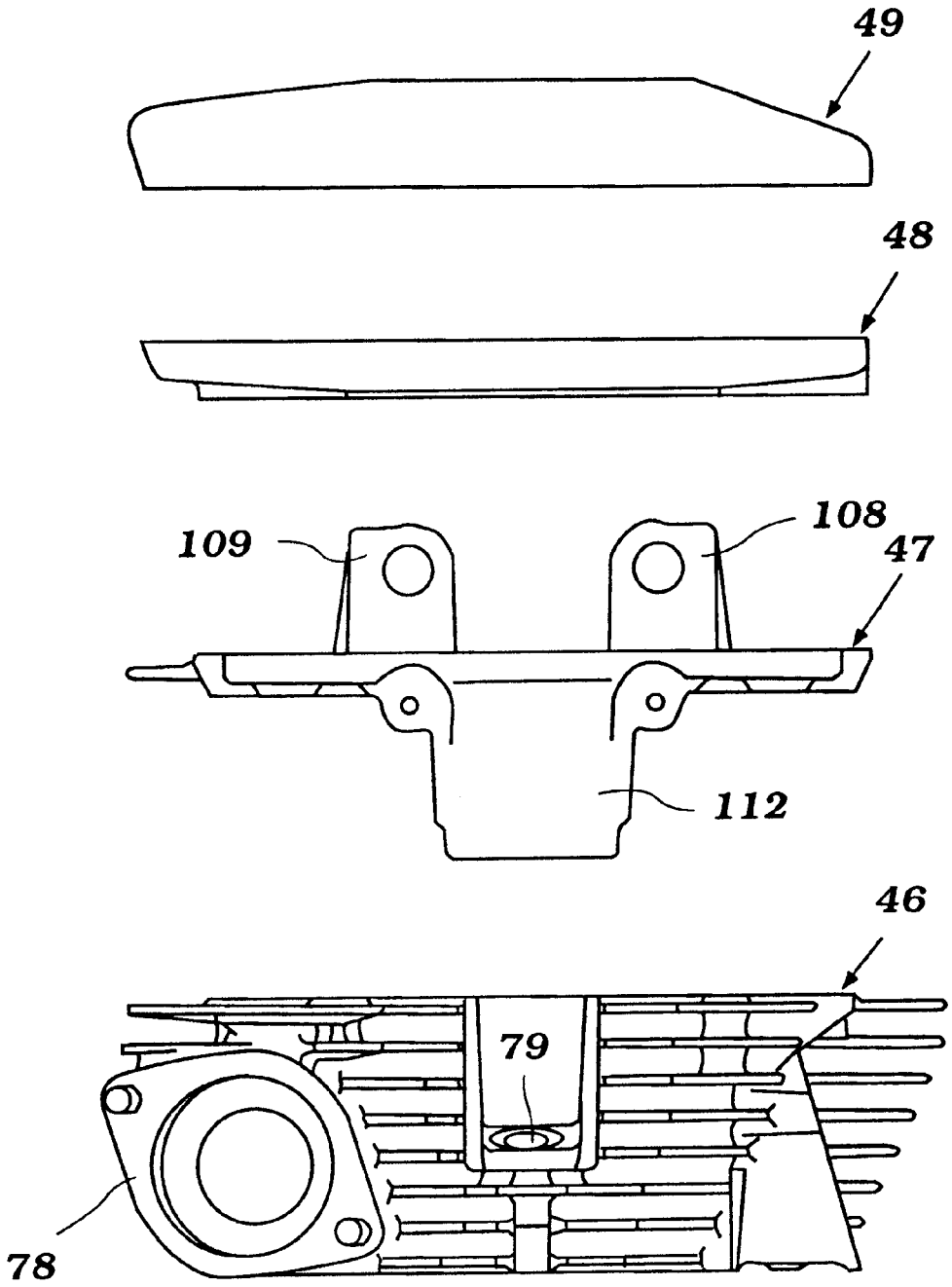
FIG. 12 is an exploded view showing one of the cylinder head assemblies.

A cylinder head assembly, indicated generally by the reference numeral 44 is affixed to each cylinder bank 36 and 37 by means that include threaded fasteners 45. The cylinder head assemblies 44 are each made up of four major components. These comprise a main cylinder head member 46, a camshaft carrier 47, a cylinder head cover 48 and a valve cover 49. These main components are shown in FIG. 12 and will be described in more detail later by reference to this and other figures.

Still continuing to refer primarily to FIGS. 2 and 3, the transmission assembly for driving the rear wheel 31 from the crankshaft 39 will now be described. As has been previously noted, this transmission assembly is contained in part in the combined crankshaft transmission assembly 32.

Affixed to one end of the crankshaft 39 is a main drive gear 51 which is enmeshed with a driven gear 52 of a change speed transmission, indicated generally by the reference numeral 53. The driven gear 52 is coupled via a selectively actuatable multiple disc clutch 54 to a primary shaft 55 of the change speed transmission 53.

This primary shaft 55 carries a plurality of primary gears which are enmeshed with secondary gears that are carried on a secondary shaft 56 of the transmission 53. By selectively coupling the gears on the primary and secondary shafts 55 and 56 to the shafts through a suitable shifting mechanism, it is possible to change the drive ratio between the crankshaft 39 and the secondary shaft 56. The secondary shaft 56 thus, functions as the output shaft of the change speed transmission 53.

An understanding of the details of the transmission 53 is not believed to be necessary to permit those skilled in the art to practice the invention. It should be readily apparent that the invention may be utilized in conjunction with any desired type of transmission.

The secondary transmission shaft 56 or output shaft carries a sprocket or toothed wheel 57 which is engaged with a drive belt 58. This drive belt 58 is contained within a transmission case enclosed by a cover assembly 59.

The drive belt 58 drives a further sprocket 61 that is coupled to a transmission output shaft 62. A further drive sprocket or pulley 63 is affixed to the opposite end of this output shaft 62. This belt drives the rear wheel sprocket 34 as previously noted.

The construction of the cylinder head assembly 44 will now be described by primary reference to FIGS. 3, 4 and 12–14. As has been previously noted, the cylinder head assembly 44 is made up of four major components, the main cylinder head member 46, the rocker arm carrier 47, the cylinder head cover 48, and the valve cover 49. These components are preferably formed from light alloy materials, such as cast aluminum or aluminum alloys.

The main cylinder head member 46 is formed with a recess 64 in its lower surface which overlies the cylinder bore 41 and forms the combustion chamber of each cylinder bank 36 and 37 with the head of the piston 42 and with the cylinder bore 41. In the illustrated embodiment, the cylinder head recess 64 is formed with four ports, two of which lie on the side of the engine toward the valley between the cylinder banks 36 and 37 and which comprise intake ports.

These ports are served and supplied with a fuel air charge by an induction system. This induction system includes carburetors 65 or other charge formers that are conveniently disposed between these cylinder banks 36 and 37 and which are associated with the intake passages of the respective cylinder head assemblies 44. These intake passages are shown partially in phantom in FIG. 4 and are identified by the reference numerals 66. These passages terminate in an outer surface 67 of each cylinder head member 46 and receive the respective carburetors 65.

Poppet-type intake valves 68 are slidably supported in each cylinder head member 46 by means that include valve guides 69. These valves 68 are urged toward their closed position in closing relationship to the intake ports, which appear in FIG. 4 and are identified by the reference numeral 71 by coil compression spring assemblies 72. These spring assemblies 72 act against keeper retainer assembly 73 for holding the valve 68 in their closed position. The mechanism for opening the valve 68 will be described later.

On the side of the cylinder head recesses 64 opposite the intake ports 71, there are provided exhaust ports. These exhaust ports are valved by poppet-type exhaust valves 74 which are also reciprocally mounted in the cylinder head members 46 by means of valve guides 75. Coil compression spring assemblies 76 act against keeper retainer assembly 77 for holding the exhaust valves 74 in their closed position. These exhaust valves 74 are opened in a manner which will also be described shortly.

The exhaust ports in the cylinder head members 46 terminate in respective exhaust outlet openings 78 formed in the cylinder head members 46 and which are adapted to detachably received an exhaust system for discharging the exhaust gasses from the combustion chambers to the atmosphere. Since the exhaust system constitutes no part of the invention, it has not been illustrated and will not be described. Those skilled in the art will readily understand how the invention can be utilized with a wide variety of types of exhaust systems.

The four valve per cylinder, cylinder head assembly 44 as thus far described is further complimented by a means of a dual ignition system. To this end, the cylinder head members 46 are each formed with a pair of tapped openings 79 that receive spark plugs 81 as best seen in FIG. 3. These spark plugs 81 are fired by a suitable ignition system and will ensure rapid flame propagation and complete combustion of the fuel air charge that has been delivered to the combustion chambers from the carburetors 65. At this point, it might be well to state that although the invention is described in conjunction with a carbureted engine, the principles of the invention can be equally as well utilized with engines having other types of charge formers, such as fuel injection systems.

The valve operating mechanism for operating the intake valve 68 and exhaust valves 74 for each cylinder bank will now be described by particular reference to FIGS. 4–11, although this valve operating mechanism also appears in other figures.

First, it should be noted that the crankcase member 38 is formed with an internal wall that has a central opening 82 through which one and of the crankshaft 39 extends. A timing gear 83 is affixed for rotation with this end of the crankshaft 39 by means that include a fastener assembly 84 and key arrangement so that the timing gear 83 will be driven at crankshaft speed. The wall of the crankcase member through which the crankshaft extends is formed with a cylindrical projection indicated in the drawings by the reference numeral 85 for reference purposes.

Figure 8:
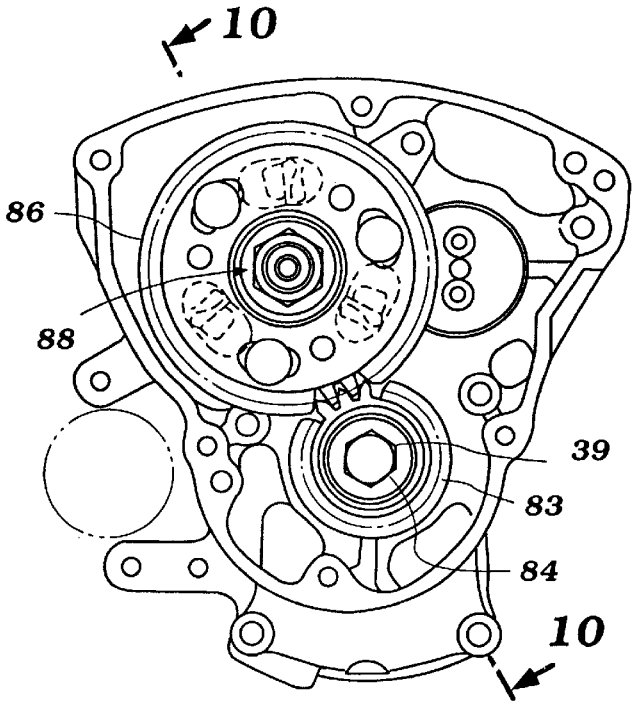
FIG. 8 is a view looking in the same direction as FIGS. 5 and 6 but shows the decompression mechanism associated with the engine.
Figure 10:
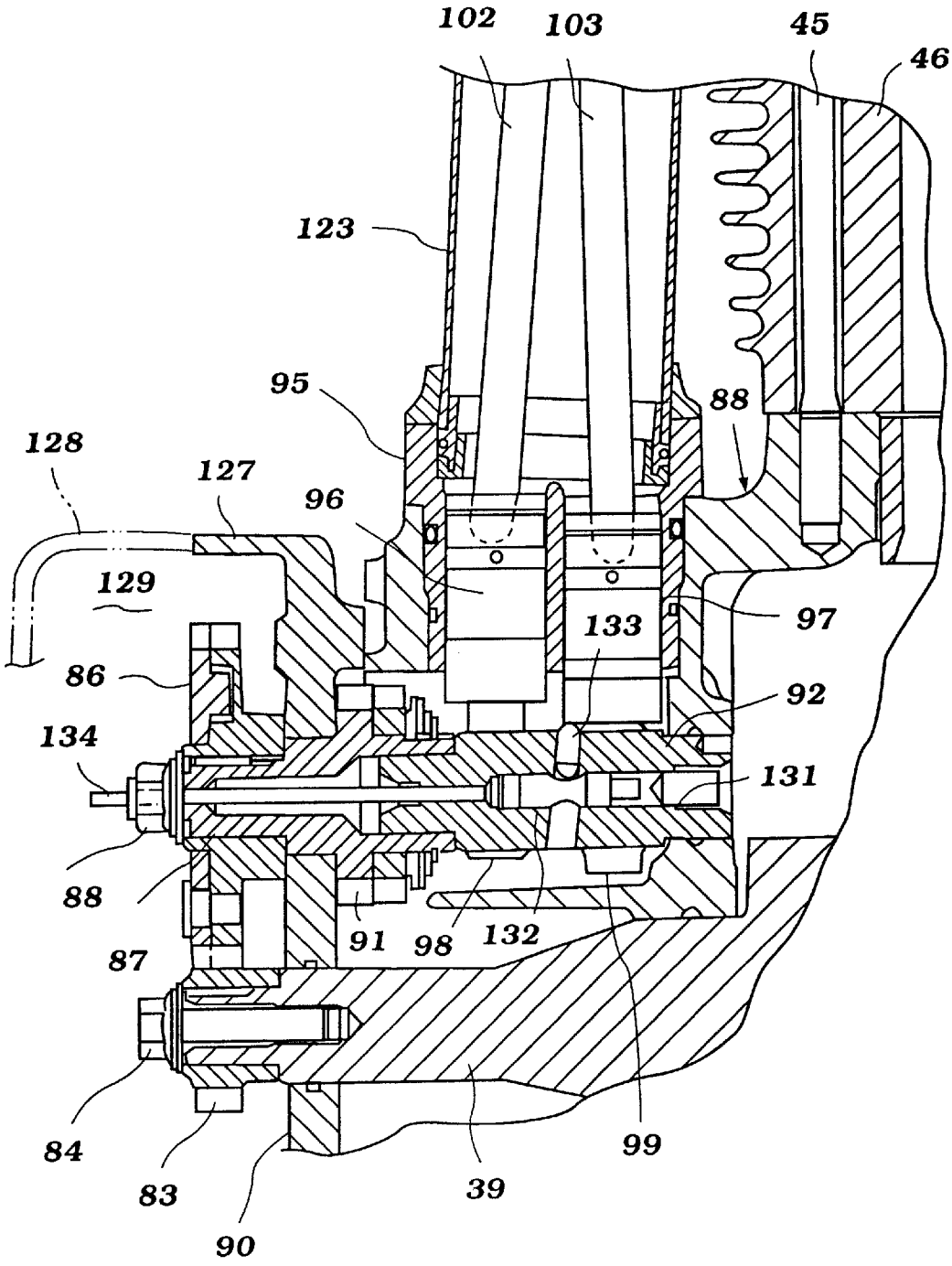
FIG. 10 is an enlarged cross-sectional view taken along a line 10—10 of FIG. 8 and shows the decompression actuating mechanism.
Figure 11:
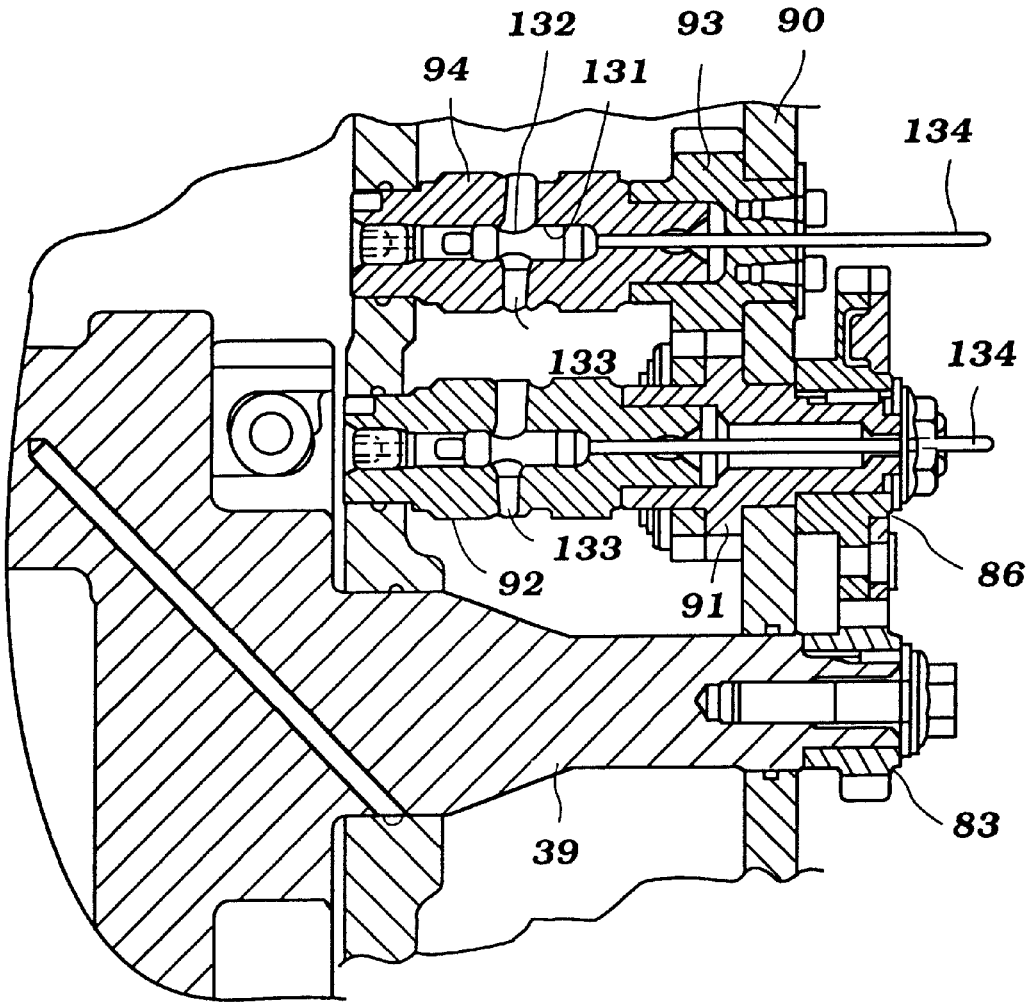
FIG. 11 is a view looking generally in the direction perpendicular to that of FIG. 10 and shows the interrelationship between the decompression mechanism for each cylinder bank.

As best seen in FIGS. 8, 10 and 11, the timing gear 83 is encircled by the projection 85 and is in this area enmeshed with a driven camshaft timing gear assembly, indicated generally by the reference numeral 86. This timing gear assembly 86 is of the split gear type so as to take up backlash in the system. This assembly is held onto a cam driving shaft 87 by means of a threaded fastener 88.

This shaft 87 penetrates through a cover 90 that forms a gear case with the wall projection 85 and there drives a first camshaft driving gear 91 which has a driving relationship with a first camshaft 92 which is associated with one of the cylinder banks 36 and 37. In the illustrated figures, this is the cylinder bank 37.

Figure 9:
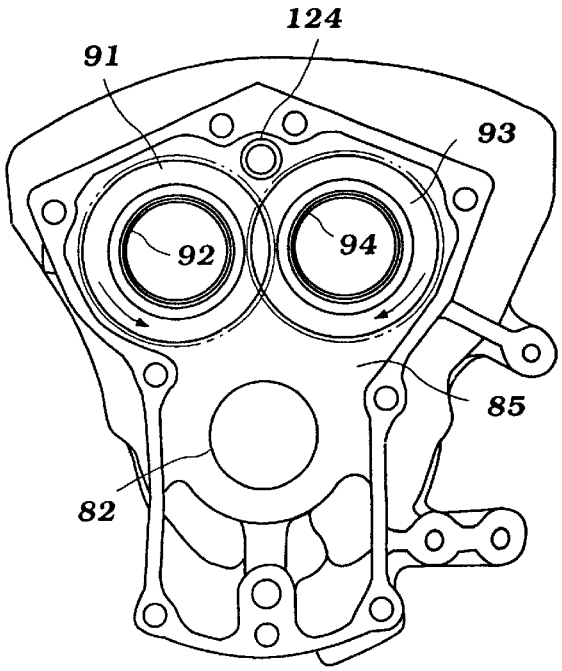
FIG. 9 is a view looking in the same direction as FIG. 8 and showing the construction for the timing drive to interrelate the camshaft so that they will rotate in opposite directions from each other.

The driving gear 91 is also a split-type backlash take up type of gear and is drivingly coupled to a second camshaft driving gear 93 which is associated with a camshaft 94 for the remaining cylinder bank, i.e., the cylinder bank 36. Because of this relationship between the driving gears 91 and 93, these gears will rotate in opposite directions as seen in FIG. 9. This is done for a reason which will become more apparent shortly.

The area above the crankcase member projection 38 adjacent each camshaft 92 and 94 and on the upper side thereof is formed with an opening that receives a tappet body 95. Each tappet body 95 is formed with a pair of bores that receive, respectively, an intake tappet 96 and an exhaust tappet 97 for the respective cylinder banks. These tappets 96 and 97 are engaged by the intake and exhaust cam lobes 98 and 99, respectively, of each camshafts 92 and 94. Since the construction of each camshaft is basically the same, except for the fact that they rotate in opposite directions, the same reference numerals are applied to the cam lobes 98 and 99 and the tappet bodies 96 and 97 for each cylinder bank.

As has been noted, the engine 22 is air cooled and to this end, both the cylinder barrels 36 and 37 are formed with cooling fins 101. These cooling fins 101 extend generally around the periphery of the engine body, but are partially interrupted on the sides adjacent the camshaft 92 and 94 so as to provide recesses through which push rods 102 and 103 for each cylinder bank extend. The push rods 102 are associated with the intake tappets 96, while the push rods 103 are associated with the exhaust tappets 97. These push rods 102 and 103 extend upwardly and in effect cross over each other slightly as seen in FIG. 2. These push rods 102 and 103 are encircled by a protective tube in a manner which will be described shortly.

Referring now primarily to FIGS. 4 and 12–14, the intake and exhaust valve push rods 102 and 103, respectively, extend upwardly along the side of the respective cylinder barrels 36 and 37 to the cylinder head assemblies 44. The upper end of each of these push rods 102 and 103 cooperate with respective rocker arms 104 and 105 that are supported for pivotal movement on rocker arm shafts 106 and 107.

These rocker arm shafts 106 and 107 are journaled in bosses 108 and 109, respectively, formed in the cylinder head top piece 47. As may be best seen in FIG. 13, the rocker arms 102 and 103 pass through a central opening 111 formed in a downwardly extending guide portion 112 of the rocker arm carrier 47.

The rocker arms 104 and 105 have follower portions 113 and 114 that define spherical sockets into which the ends of the push rods 102 and 103 extend. These extensions 113 and 114 are formed at one side of the rocker arm assemblies 104 and 105. At the other ends thereof, the rocker arm assembly 104 has a pair of extending arms 1 15 and 116 that are engaged with the tips of the intake valves 48 for their actuation. An adjusting screw 117 is provided on only one of these rocker arm extensions, this being the extension 115, so as to permit adjustment of the lash in the intake valve train.

In a similar manner, the rocker arm 105 has a pair of valve actuating portions 118 and 119 that cooperate with the tips of the stems of the exhaust valves 74 for their actuation. Again, only the rocker arm portion 118 carries an adjusting screw 121 for adjusting the lash in the exhaust valves.

Figure 13:
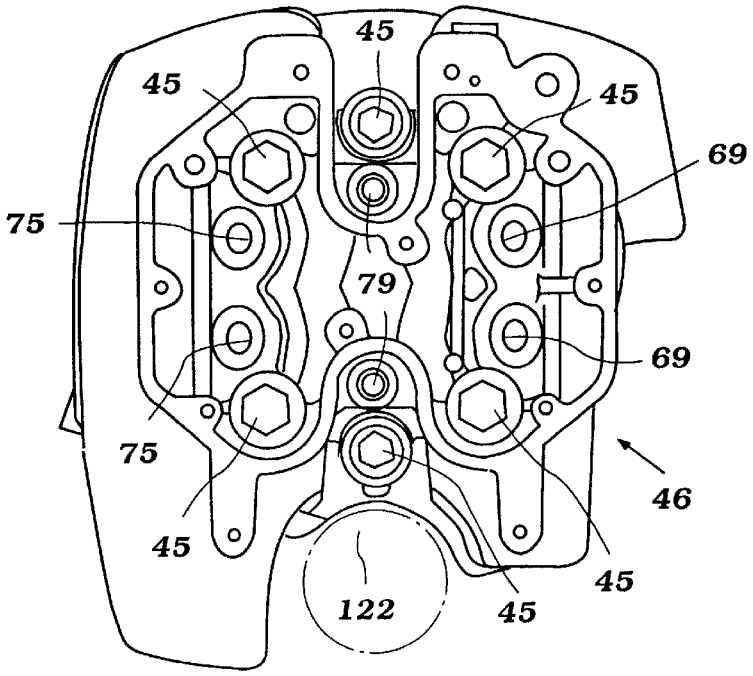
FIG. 13 is a top plan view of the cylinder head assembly with the rocker arm carrier not yet installed.
Figure 14:
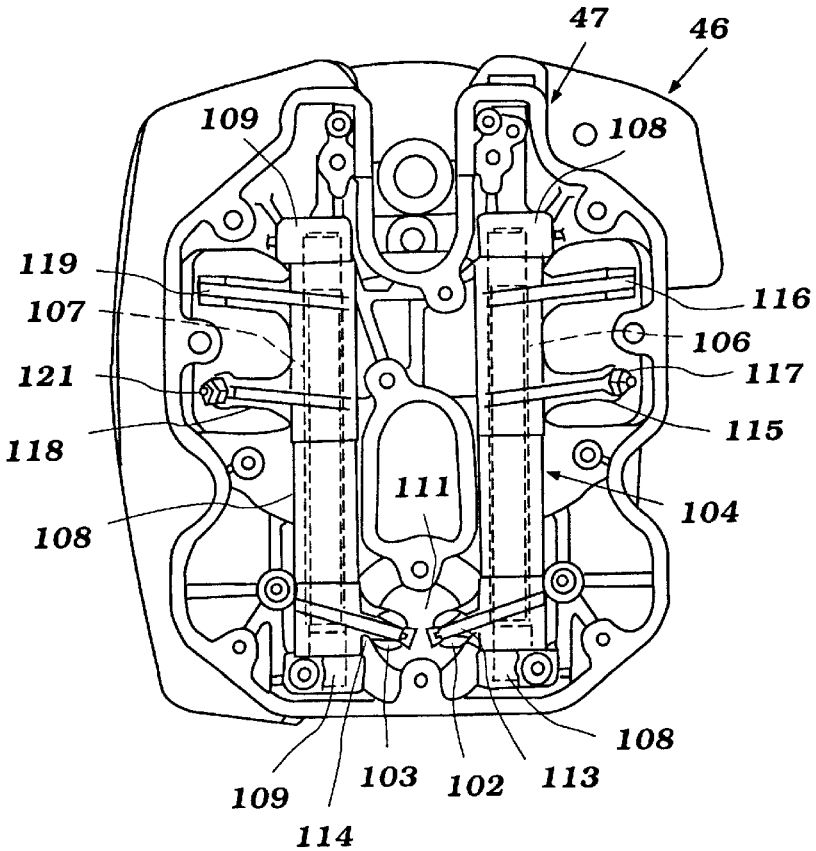
FIG. 14 is a is a view looking in the same direction as FIG. 13 but shows the rocker arms journalling portion of the cylinder head assembly installed and with only the valve cover removed.

As may be best seen in FIG. 13, the cylinder head member 46 has openings to receive the fasteners 45 that affix the cylinder head member 46 to the cylinder blocks 36 and 37 and this assembly to the crankcase member 38. The rocker arm carrier 47 is suitably affixed to the cylinder head member 46. The head cover 48 is then fixed to the upper side of the rocker arm carrier 47 and the valve actuating mechanism is then closed by the valve covers 49.

Figure 2:
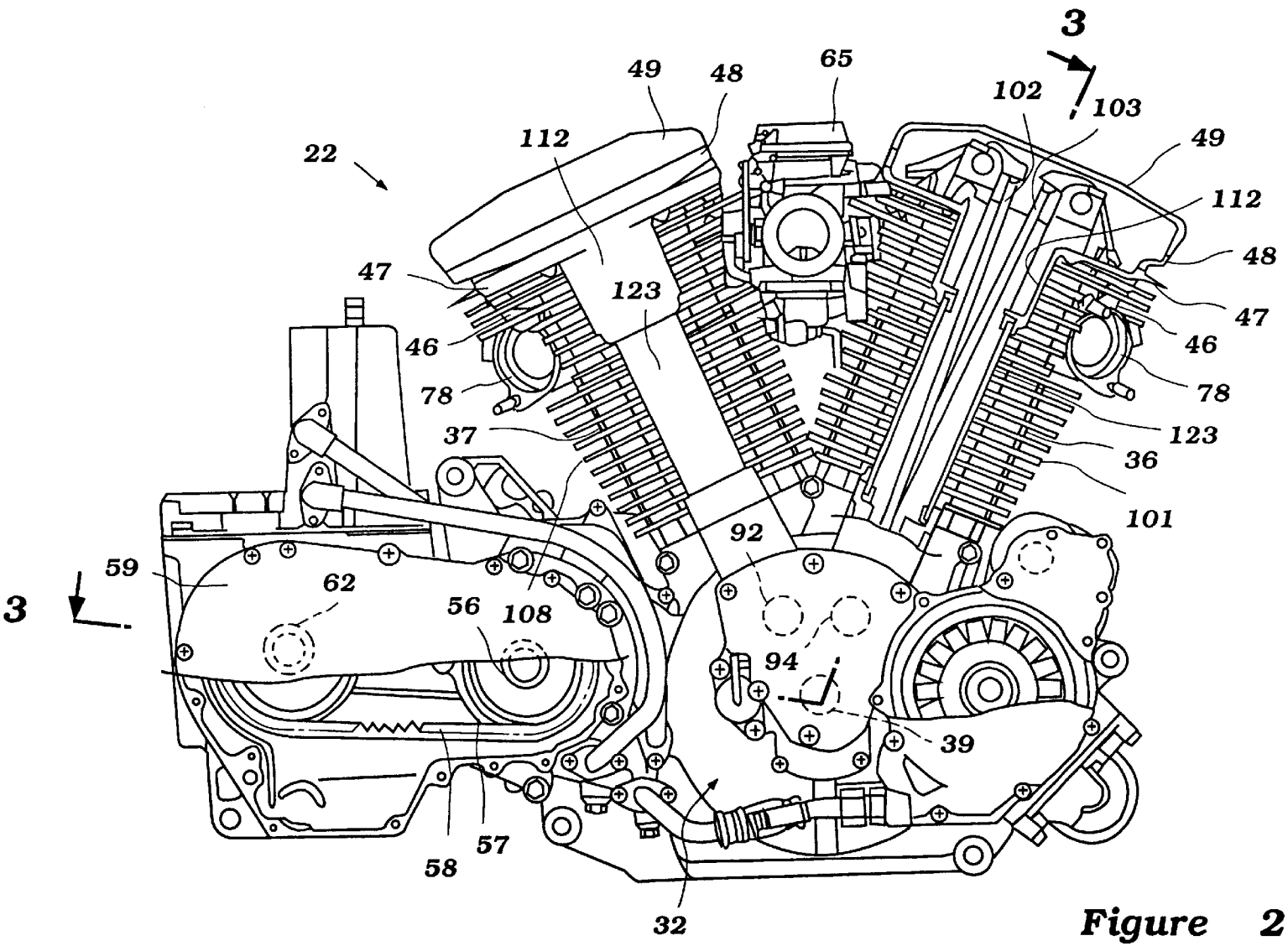
FIG. 2 is a side elevational view of the engine looking in the opposite direction from FIG. 1 and with the push rod covers either partially or completely removed and other portions broken away to show the valve operating mechanism.
Figure 3:
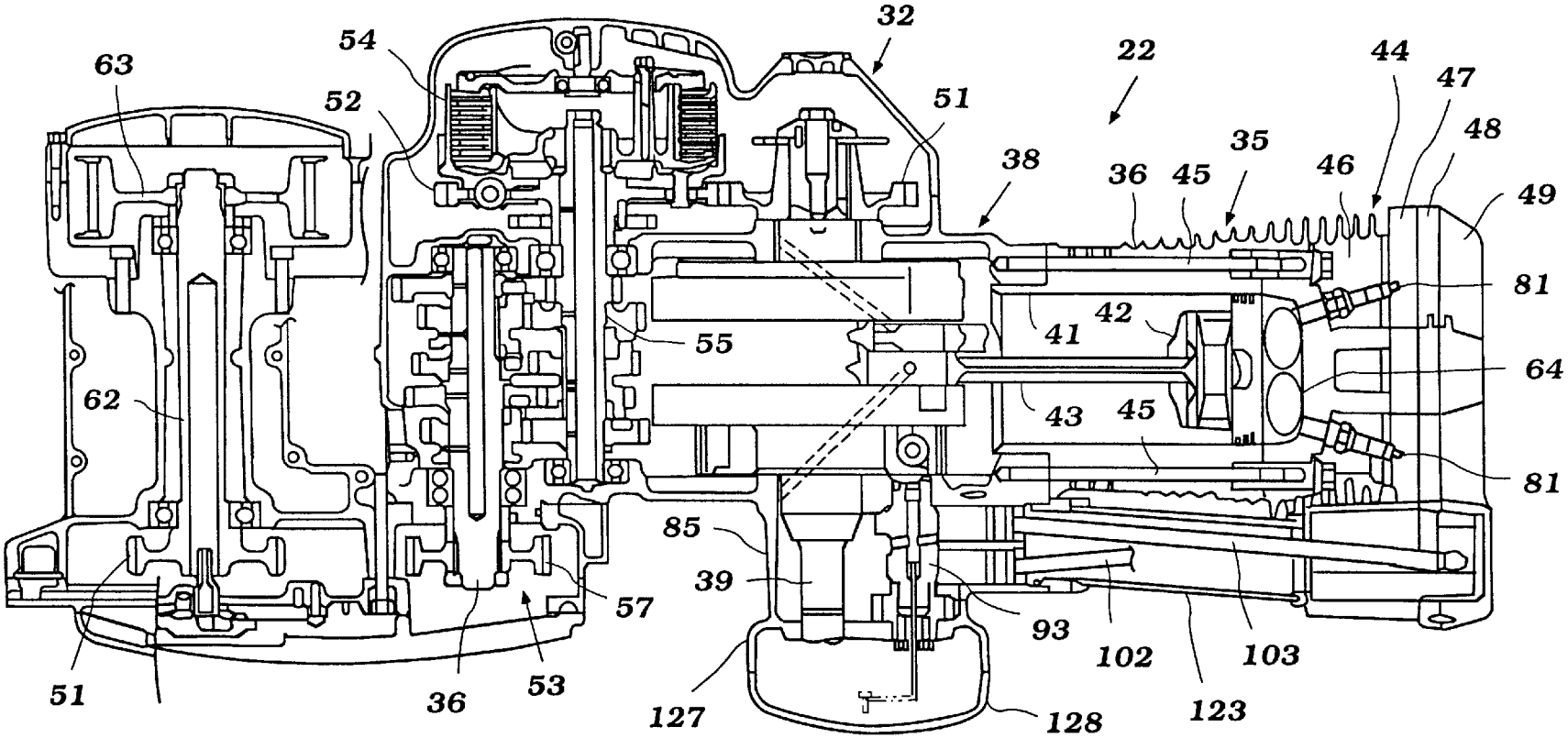
FIG. 3 is a cross-sectional view taken generally along the line 3—3 of FIG. 2.

As best seen in FIGS. 2, 3 and 13, the cylinder blocks 36 and 37 have recesses formed in one side thereof which are indicated generally by the reference numeral 122 that appears in FIG. 13. The push rods 102 and 103 extend through these recesses and are encircled by push rod tubes 123. As seen in FIG. 10, the lower ends of these push rod tubes 123 are sealingly engaged with the tappet carrier member 95 that is fixed to the crankcase member 38 and thus provide a good seal and protection in this area.

Figure 4:
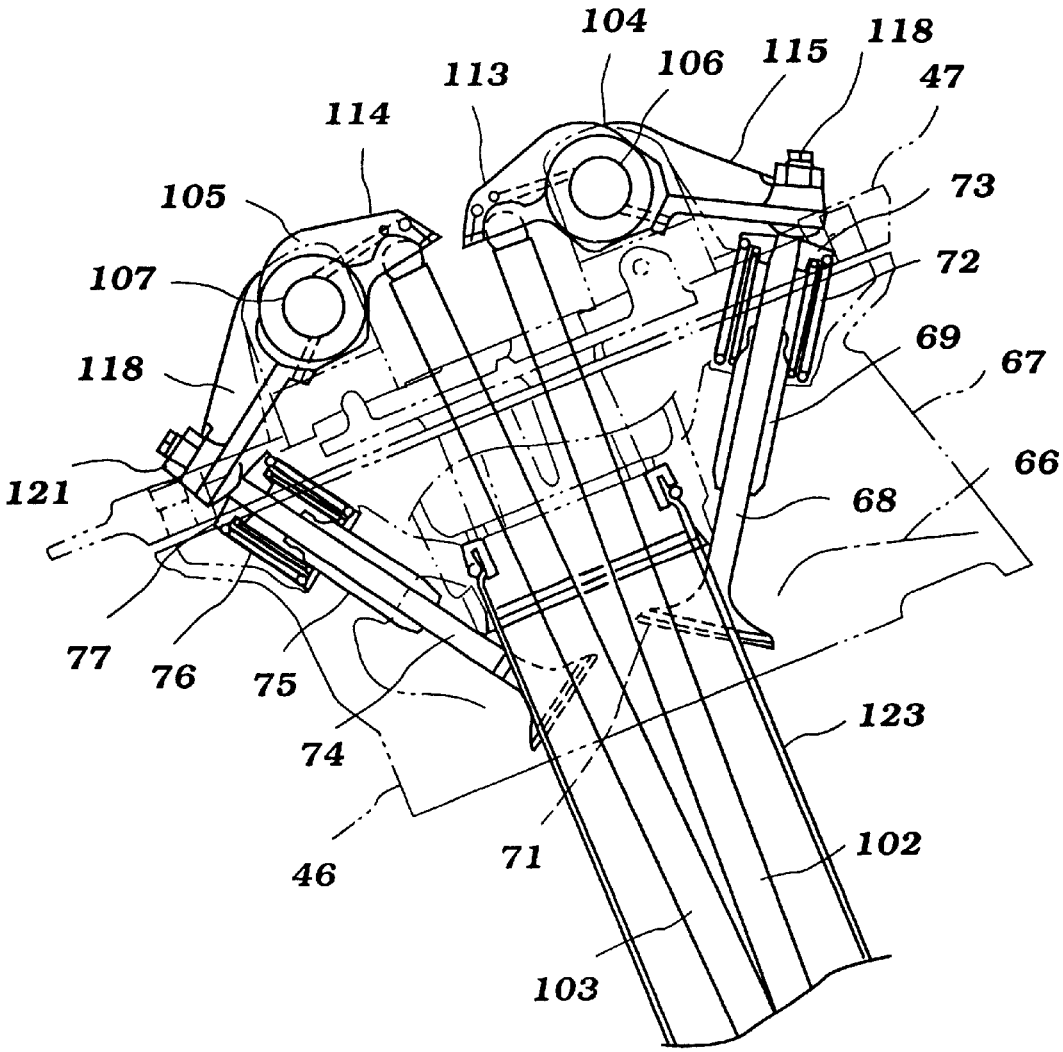
FIG. 4 is an enlarged view showing the valve operating mechanism associated with one of the cylinder heads with the main cylinder head component being shown in phantom.

In a like manner, the upper ends of these push rod tubes 123 are sealingly engaged within the projections 112 of the rocker arm carrier 47 as may be seen in FIGS. 2 and 4 and thus, the push rods 102 and 103 are well protected, but there is a neat overall appearance to the engine. Also, the push rods 102 and 103 can be easily removed for servicing, as should be readily apparent.

This invention deals with the lubrication system for the camshafts 92 and 94 and particularly their point of engagement with the tappets 97. This arrangement may be best understood by reference to FIGS. 5–7.

As may be seen, the crankcase member 38 is provided with an oil gallery 124 that is formed in a manner to be described and that extends in the area between the rotational axes of the camshafts 92 and 94 and vertically upwardly therefrom between the tappets 97. This oil gallery 124 is drilled with feeder ports 125 and 126, respectively, which are directed toward the area where the lobes 98 and 99 of the camshafts 92 and 94 engage the respective tappets 97.

Figure 5:
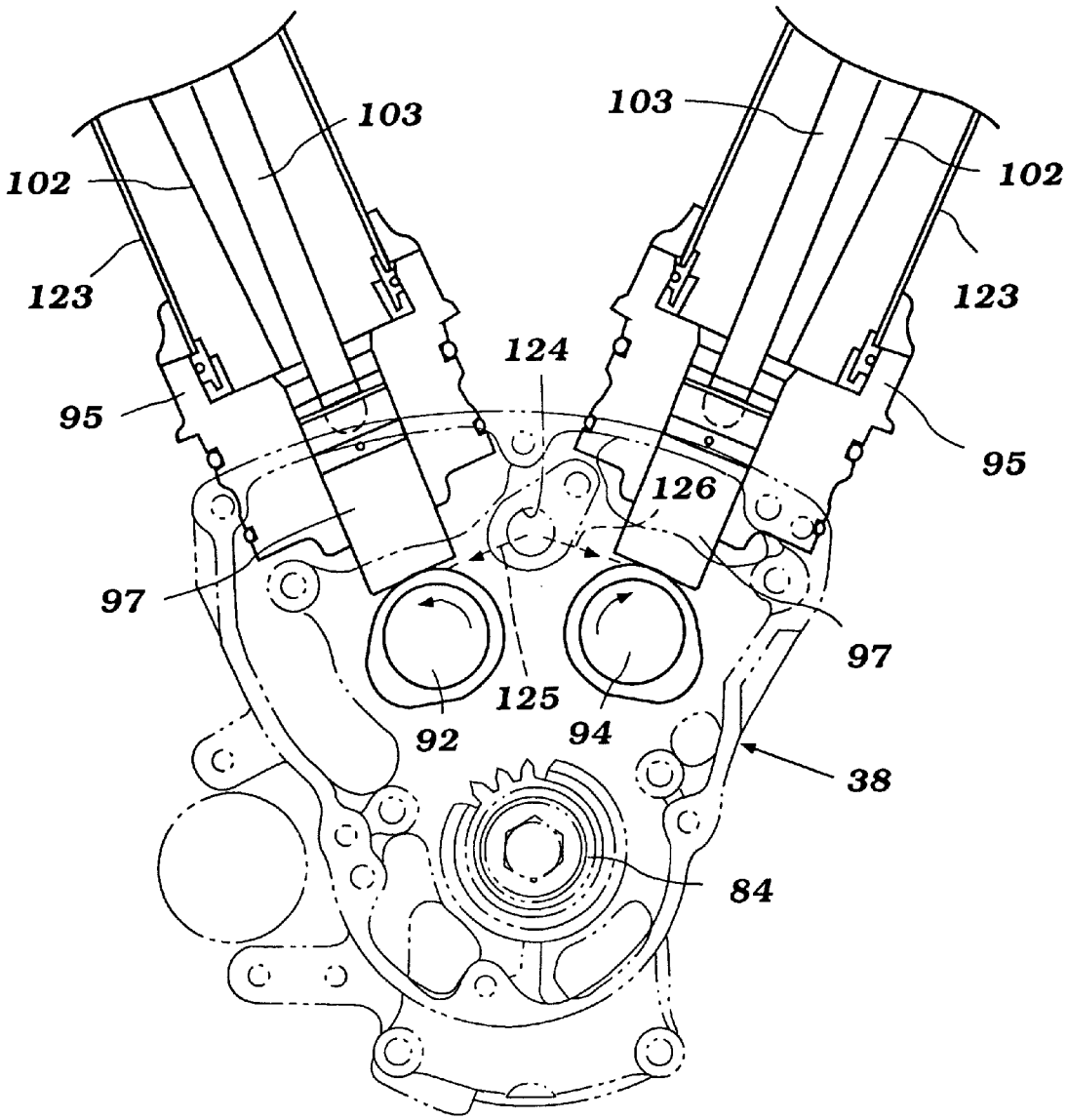
FIG. 5 is a view showing the lower ends of the push rods the upper ends of which are shown in FIG. 4 and their driving relationship with the camshafts journaled within the crankcase.
Figure 6:
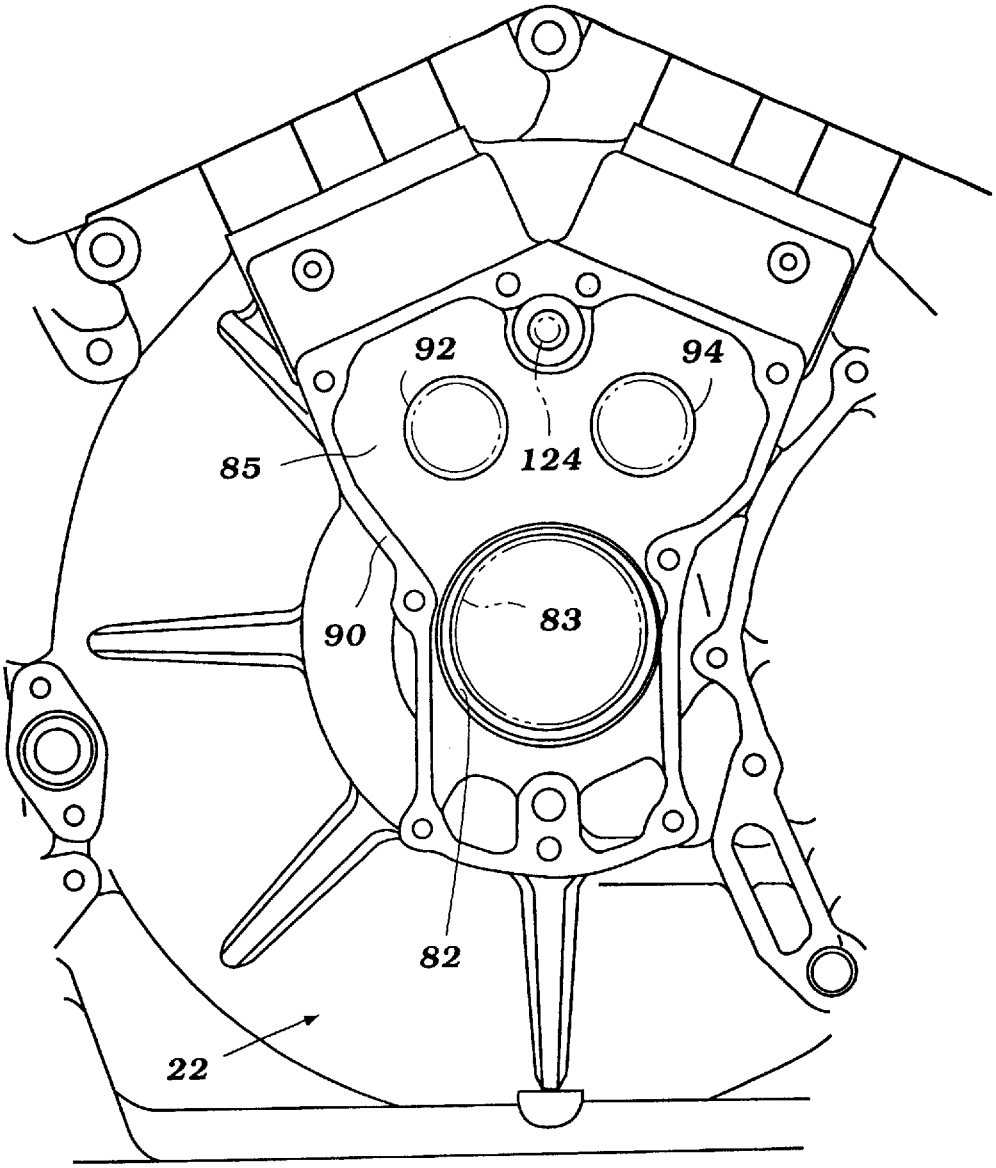
FIG. 6 is a view looking in the same direction as FIG. 5 but with the camshafts and crankshaft removed and showing more clearly the arrangement utilized to lubricate the camshaft operating mechanism.

It should be remembered that the camshafts 92 and 94 rotate in opposite directions as seen by the arrows in FIG. 5. As a result of this, the lubricant that is sprayed by the feeder ports 125 and 126 will be engaged with the cam surfaces that are rotating into engagement with the follower portions of the tappets 97. Therefore, lubricant will be carried by the rotation into this area so that there will be provided adequate and copious amounts of lubrication for the cam mechanism and the tappets 96 and 97.

Figure 7:
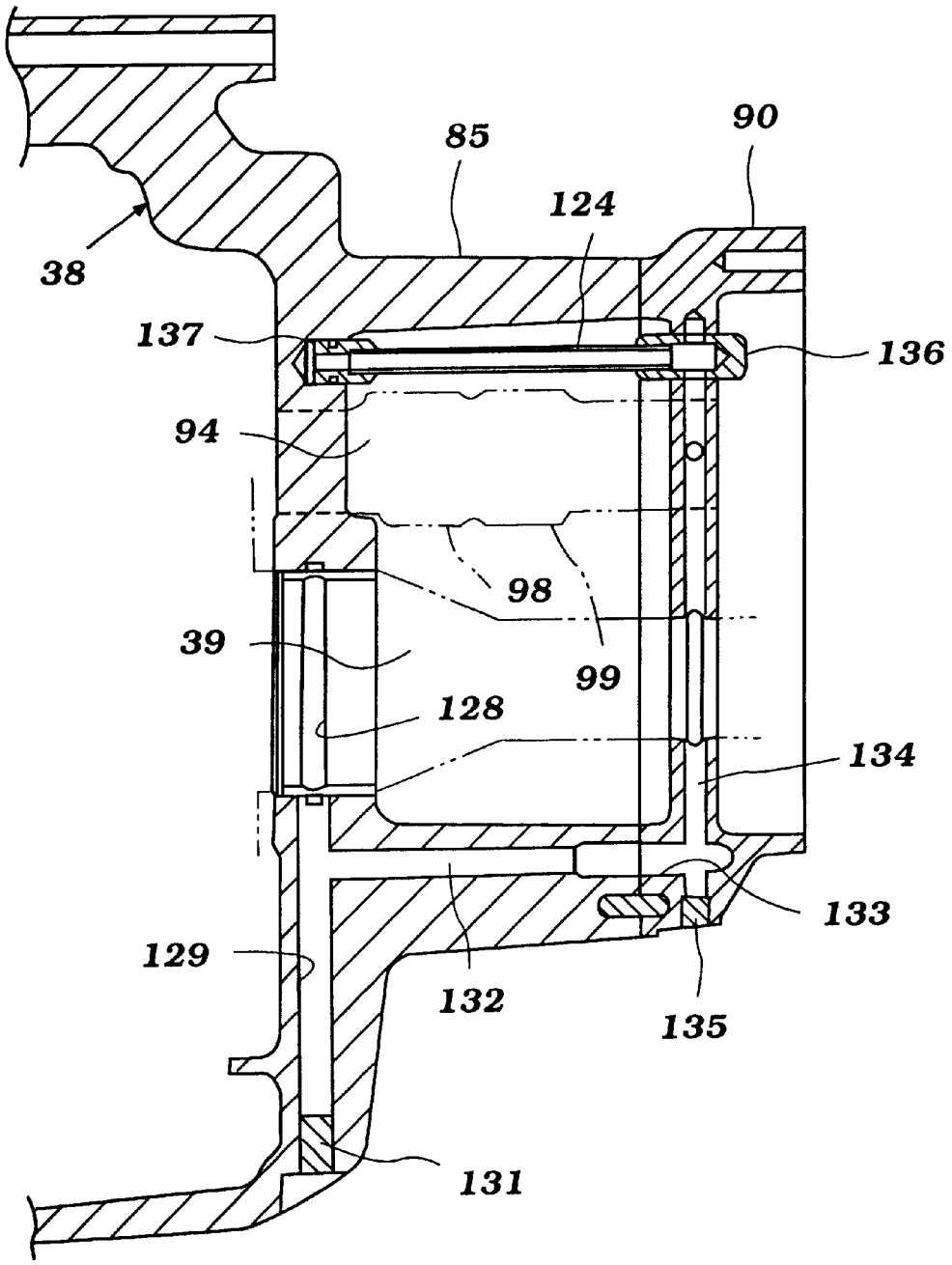
FIG. 7 is an enlarged cross sectional view taken along the line 7—7 in FIG. 5.

The manner in which lubricant is delivered to the gallery 124 will now be described by primary reference to FIGS. 3 and 7. First, it should be noted that the engine 22 is provided with a lubricating system that includes a pump (not shown) that delivers oil under pressure to various components of the engine including the crankshaft 39.

To this end, the crankshaft 39 is provided with drilled passages 127 (FIG. 3) which extend from a main oil gallery to the main and rod bearing journals of the crankshaft 39. Adjacent the front main bearing for the crankshaft 39, the drilled passageway 127 terminates in a circumferential groove 128 (FIG. 7) which is in line with the crankcase member 38 adjacent the cylindrical projection 85. This groove mates with a drilled passageway 129 formed in the end of this part of the crankcase member 38 and which is closed at its outer end by a plug 131.

A further drilled passageway 132 intersects the drilled passageway 129 and extends outwardly to communicate with a corresponding passageway 133 formed in the cover member 90. The cover member 90 further has an intersecting drilled passageway 134 which is closed at one end by a plug 135. This passageway 134 intersects a fitting piece 136 which receives one end of the oil gallery 124. The other end of the oil gallery 124 is mounted in a fitting 137 formed in the crankcase member 138. Hence, lubricant is delivered to the gallery 124 in this manner and provides the effective lubrication of the cam shafts 92 and 94, their cam lobes 98 and 99 and the tappets 97.

Finally, the engine 22 is provided with a decompression mechanism for facilitating starting. This decompression mechanism is shown best in FIGS. 10 and 11. As has been noted, there is a timing drive for driving the camshafts 92 and 94 from the crankshaft 39 at one half crankshaft speed. This timing mechanism is contained within a timing case formed by an outwardly extending flange 137 of the crankcase cover piece 90. A timing case cover 138 is affixed to and encloses the timing gear drive and specifically the intermeshing gears 83 and 86 within this case, indicated by the reference numeral 139.

Each of the camshafts 92 and 94 is formed with a respective bore 141 that receives a decompression actuating cam 142. These cams 142 are engageable with lift plungers 143 that engage the exhaust tappets 96. An actuating pin 144 extends through the outer end of the camshafts 92 and beyond the timing gear 86 within the case 139. These actuating pins 144 are actuated by a suitable mechanism and when so actuated will move the cam 142 so as to urge the plunger 143 outwardly and lift the exhaust tappets 97. This will, in effect, open the exhaust valves.

This is done during a portion of the compression stroke. As may be seen in FIG. 10, the plungers 143 are generally aligned with the ends of the lift portions of the intake cam lobes 98 so that the exhaust valves will be opened at a time during the compression stroke and thus, relieve the pressure in the cylinder so as to make cranking and starting easier. As noted, any suitable form of actuating mechanism can be employed for providing this decompression for starting.

Thus, from the foregoing description, it should be readily apparent that the engine construction is quite compact and provides a very effective way for operating the multiple valves through multiple camshafts and providing adequate lubrication for the valve actuating mechanism for the engine in a simple, but highly effective manner. Of course, the foregoing description is that of the preferred embodiment of the invention and various changes and modifications may be made without departing from the spirit and scope of the invention, as defined by the appended claims.

What is claimed is:

1. A valve train lubricating system for an engine, said valve train including a pair of spaced cam shafts each having at least one cam lobe thereon and which are journaled for rotation within an engine body, each of said cam lobes cooperating with a respective follower mechanism for operating a respective, associated engine valve, a lubricant delivery passage provided in said engine body in spaced relationship to said cam shafts and to said cam lobes, said lubricant delivery passage having discharge ports directed toward said cam shafts to spray lubricant on said cam lobes and said followers.

2. A valve train lubricating system as set forth in claim 1 wherein the lubricant delivery passage has discharge ports directed toward each of the cam lobes to spray lubricant on said cam lobes and the respective of said followers.

3. A valve train lubricating system as set forth in claim 1 wherein each cam shaft has a plurality of cam lobes and the lubricant delivery passage lubricates each of said cam lobes.

4. A valve train lubricating system as set forth in claim 3 wherein the lubricant delivery passage is spaced from the cam shafts and the cam lobes and has a plurality of discharge ports each of which sprays lubricant on a respective one of said cam lobes.

5. A valve train lubricating system as set forth in claim 1 wherein the lubricant is delivered to the cam lobes before the cam lobes next operates the followers.

6. A valve train lubricating system as set forth in claim 1 wherein the cam shafts are driven from an engine crankshaft through a timing drive, said crankshaft being lubricated through passages formed therein to which lubricant is delivered under pressure, said crankshaft passages including a cam shaft supply passage that also delivers lubricant to said lubricant delivery passage.

7. A valve train lubricating system as set forth in claim 6 wherein the crankshaft is journalled in an engine wall juxtaposed to the timing drive and the cam shaft supply passage communicates with a groove in said wall, said groove being in communication with said lubricant delivery passage.

8. A valve train lubricating system as set forth in claim 1 wherein the lubricant delivery passage is positioned between the cam shafts and the discharge ports spray lubricant thereon.

9. A valve train lubricating system as set forth in claim 8 wherein each of the cam shafts has a plurality of cam lobes and the lubricant delivery passage lubricates all of said cam lobes.

10. A valve train lubricating system as set forth in claim 9 wherein the cam shafts rotate in opposite directions and lubricant is delivered to each of the cam lobes before the cam lobe next operates the respective follower.

11. A valve train lubricating system as set forth in claim 10 wherein the cam shafts are driven from an engine crankshaft through a timing drive, said crankshaft being lubricated through passages formed therein to which lubricant is delivered under pressure, said crankshaft passages including a cam shaft supply passage that also delivers lubricant to said lubricant delivery passage.

12. A valve train lubricating system as set forth in claim 11 wherein the crankshaft is journalled in an engine wall juxtaposed to the timing drive and the cam shaft supply passage communicates with a groove in said wall, said groove being in communication with said lubricant delivery passage.

* * * * *